US009820059B2

(12) United States Patent
Zinn et al.

(10) Patent No.: US 9,820,059 B2
(45) Date of Patent: Nov. 14, 2017

(54) MESH IN MESH BACKPLATE FOR MICROMECHANICAL MICROPHONE

(71) Applicant: Robert Bosch GmbH, Stuttgart (DE)

(72) Inventors: John W. Zinn, Canonsburg, PA (US); Brett Matthew Diamond, Pittsburgh, PA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/894,388

(22) PCT Filed: May 29, 2014

(86) PCT No.: PCT/US2014/039981

§ 371 (c)(1),
(2) Date: Nov. 27, 2015

(87) PCT Pub. No.: WO2014/194062

PCT Pub. Date: Dec. 4, 2014

(65) Prior Publication Data

US 2016/0112809 A1 Apr. 21, 2016

Related U.S. Application Data

(60) Provisional application No. 61/828,664, filed on May 29, 2013.

(51) Int. Cl.
*H04R 19/04* (2006.01)
*H04R 19/00* (2006.01)

(52) U.S. Cl.
CPC ..... *H04R 19/04* (2013.01); *H04R 19/005* (2013.01); *H04R 2201/003* (2013.01)

(58) Field of Classification Search
CPC . H04R 19/04; H04R 19/005; H04R 2201/003
See application file for complete search history.

(56) References Cited

U.S. PATENT DOCUMENTS

| | | | |
|---|---|---|---|
| 7,473,572 | B2 | 1/2009 | Dehe et al. |
| 8,503,699 | B2 | 8/2013 | Dehe |
| 8,553,911 | B2 | 10/2013 | Chen |
| 2003/0123683 | A1 | 7/2003 | Raicevich |
| 2005/0002536 | A1 | 1/2005 | Gorelik et al. |
| 2010/0020991 | A1 | 1/2010 | Chen |
| 2011/0075866 | A1 | 3/2011 | Zhang |

(Continued)

FOREIGN PATENT DOCUMENTS

| | | |
|---|---|---|
| DE | 102010035168 A1 | 2/2012 |
| DE | 102012215251 | 3/2013 |

(Continued)

OTHER PUBLICATIONS

International Search Report and Written Opinion for Application No. PCT/US2014/039981 dated May 29, 2014, 8 pages.

*Primary Examiner* — Matthew Eason
(74) *Attorney, Agent, or Firm* — Michael Best & Friedrich LLP

(57) ABSTRACT

A MEMS backplate. The MEMS backplate includes a first mesh pattern having a first height and a first arrangement of openings, and a second mesh pattern having a second height and a second arrangement of vent hole apertures. The second mesh pattern is contained within the opening formed by the first mesh pattern.

20 Claims, 8 Drawing Sheets

(56) References Cited

U.S. PATENT DOCUMENTS

| | | | | |
|---|---|---|---|---|
| 2012/0225259 | A1* | 9/2012 | Mortensen | B81B 3/0078 428/195.1 |
| 2012/0237061 | A1 | 9/2012 | Corona et al. | |
| 2013/0056840 | A1 | 3/2013 | Bominaar-Silkens et al. | |
| 2013/0285173 | A1 | 10/2013 | Reimann et al. | |

FOREIGN PATENT DOCUMENTS

| | | | |
|---|---|---|---|
| EP | 1577656 | A1 | 9/2005 |
| EP | 2252077 | A1 | 11/2010 |
| JP | 2011044890 | | 3/2011 |

* cited by examiner

MESH IN MESH BACKPLATE FOR MICROMECHANICAL MICROPHONE

RELATED APPLICATION

The present patent application claims the benefit of prior filed U.S. Provisional Patent Application No. 61/828,664, filed on May 29, 2013, the entire content of which is hereby incorporated by reference.

BACKGROUND

The present invention relates to micromechanical systems ("MEMS"), such as, for example, MEMS microphone systems.

SUMMARY

In one embodiment, the invention provides a MEMS microphone system. The system includes a membrane and a counter electrode opposite the membrane, also referred to as a backplate regardless of position relative to the membrane. The backplate includes one or more attachment regions to other device layers along with a perforated region. The perforated region herein referred to as a mesh, consists of a layer with a plurality of apertures, also referred to as vent holes, which allow air to move between the membrane and backplate. In a microphone system, smaller vent holes provide the advantages of higher sensitivity and better particle filtering with the disadvantage of higher acoustic noise. Furthermore, a thinner backplate provides the advantage of lower acoustic noise with the disadvantage of lower strength and robustness. This invention allows the optimization of performance requirements including sensitivity, noise, and robustness, by using two patterns a openings, one contained within the other.

Within a mesh, the vent holes may be defined as any combination of circular apertures, polygonal apertures, or any possible shaped aperture combining curved or linear segments. In some embodiments, with proper spacing and arrangement of the vent holes, the remaining material between the vent holes may constitute beams of uniform width. Various beam widths may be utilized in various regions of the backplate, and the tessellation patterns of the vent holes may be regular or irregular and may result in a hexagon-shaped mesh, a rectangle-shaped mesh, a triangle-shaped mesh, or any other polygonal shaped mesh composed of straight beams or curved beams. In this invention, a second mesh pattern is formed within the openings of the first mesh pattern. The second pattern can be formed of a finer material that is supported by the coarser structural frame of the first pattern. In some embodiments, a tiered arrangement of mesh patterns is constructed consisting of a third pattern within the second pattern, and a fourth pattern within the third pattern, etc.

In one embodiment, the invention provides a MEMS backplate. The MEMS backplate includes a first mesh pattern having a first height, a first arrangement of openings, and a first width between openings, and a second mesh pattern having a second height, a second arrangement of vent hole apertures, and a second width between vent hole apertures. The second mesh pattern is contained within the opening formed by the first mesh pattern.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
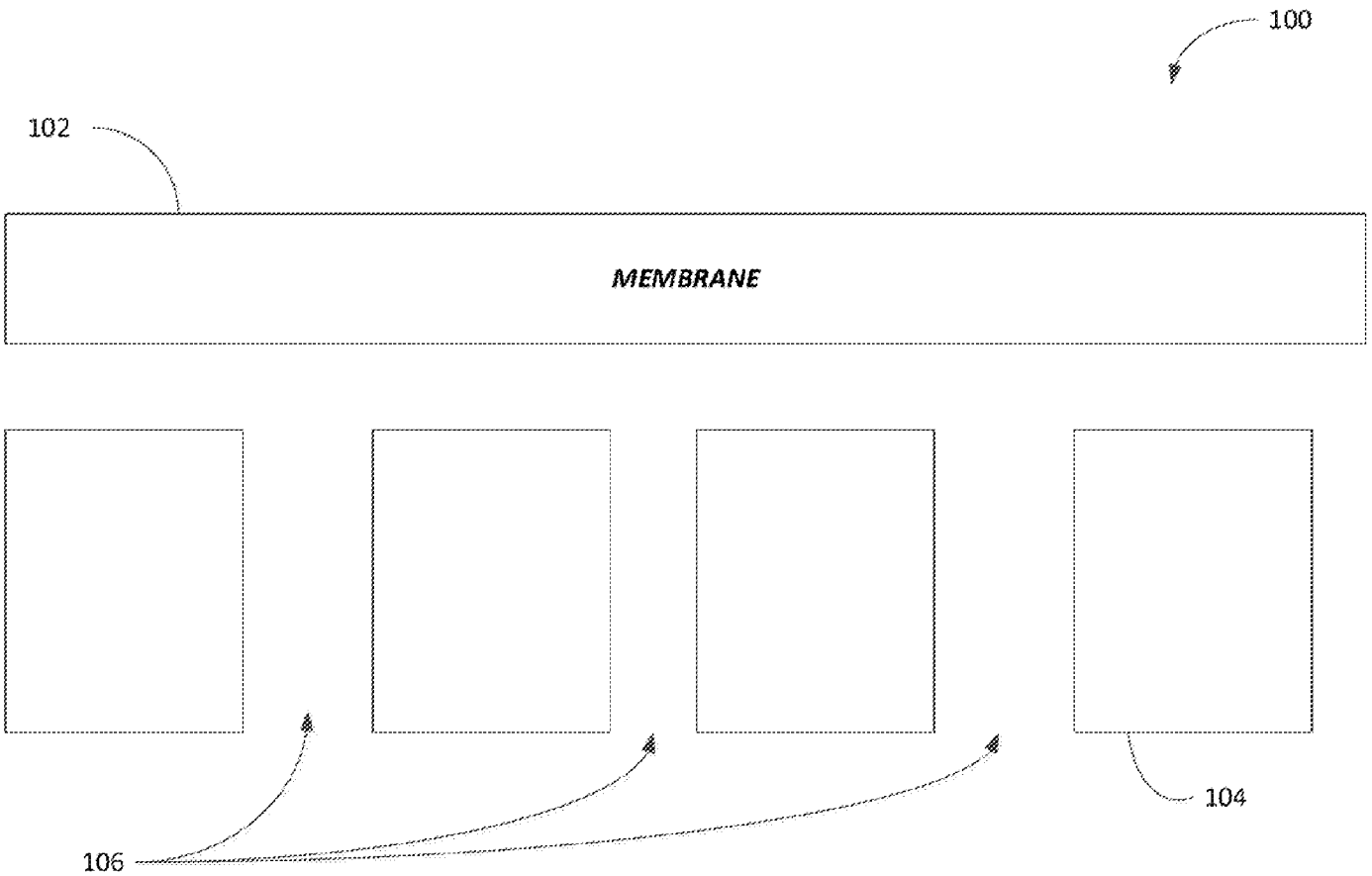
FIG. 1 Prior Art
FIG. 1 is a cross-sectional view of a prior art MEMS microphone system.

FIG. 1 is a side, cross-sectional view of a portion of a MEMS microphone system 100. As described in further detail below, the system includes a membrane 102 that moves in response to acoustic pressures and a counter electrode opposite the membrane (referred to as a backplate) 104. An electrical circuit detects movement of the membrane 102 relative to the backplate 104 (e.g., due to varying capacitance) and generates an electrical signal indicative of the acoustic pressure (i.e., sound). CMOS and/or ASIC components (e.g., integrated with the system 100 or external to the system 100) process the electrical signal.

Figure 2:
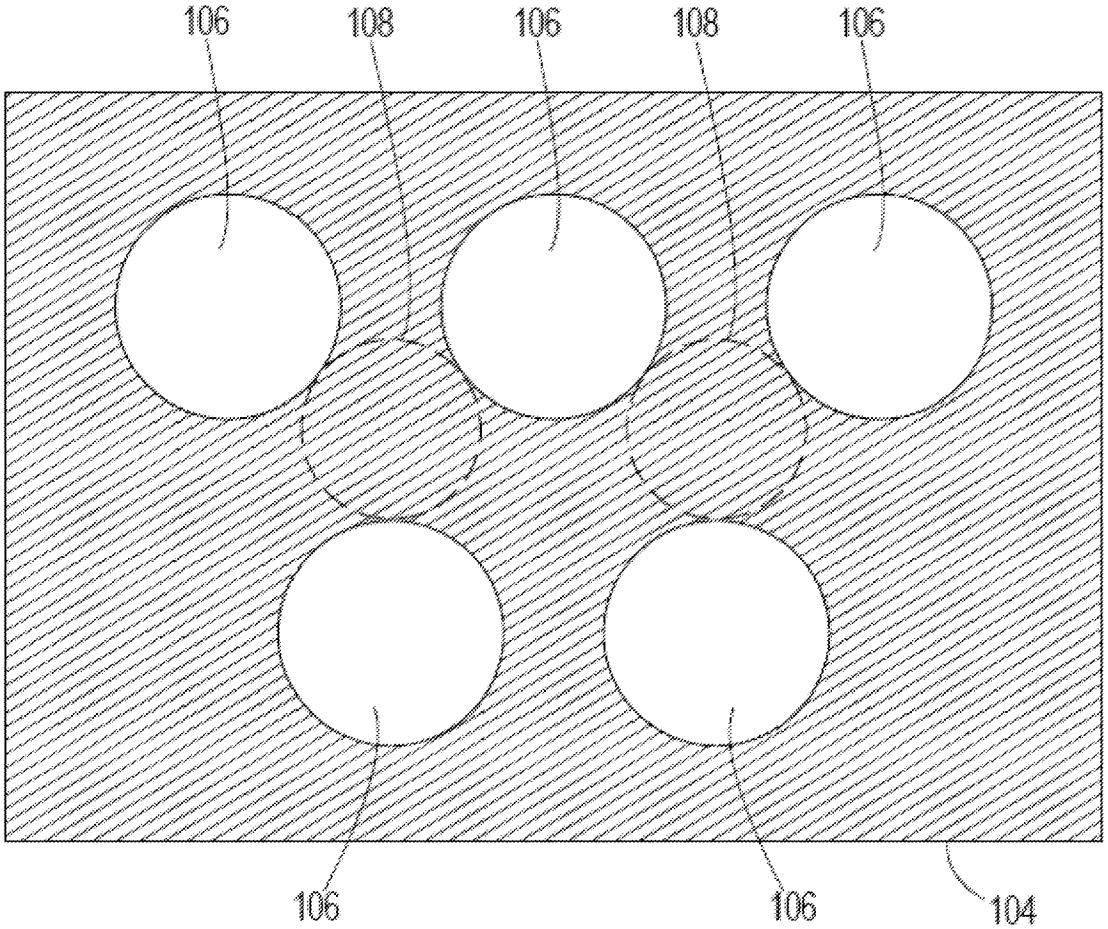
FIG. 2 PRIOR ART
FIG. 2 is a top view of a prior art backplate showing the current state of the art consisting of backplates with a perforated plate construction and a resulting non-uniform width web of material between vent holes.

As illustrated in FIG. 1, the backplate 104 includes a combination of solid regions and perforated regions (holes or vents) 106 that allow air to pass between the membrane 102 and the backplate 104. In existing systems, the backplate 104 includes a solid plate that includes a plurality of circular holes 106 (see FIG. 2). Some existing systems may incorporate a conductive layer with an insulating layer as part of the backplate.

Figure 3A:
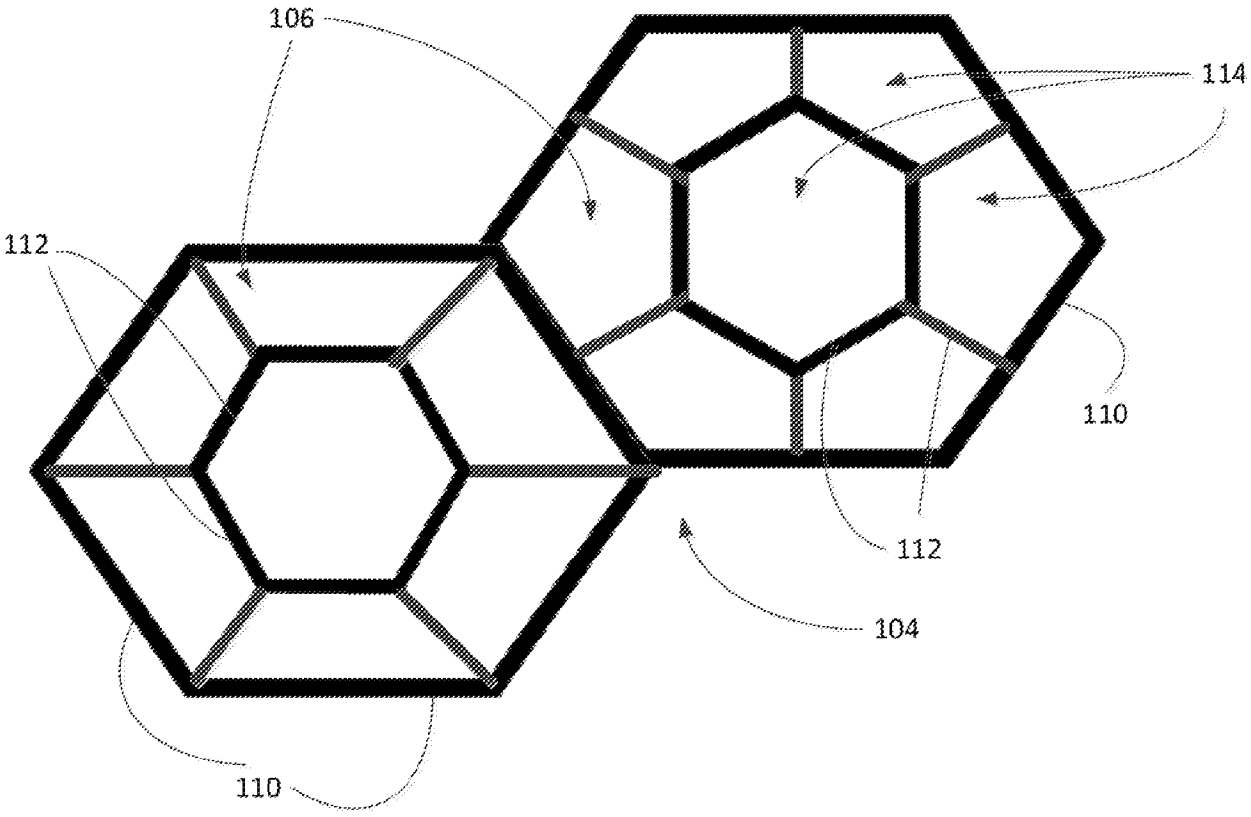
FIGS. 3*a*, 3*b*, 3*c*, and 3*d* are top views of backplates showing different implementations of first mesh pattern structures and different implementations of second mesh pattern structures contained within the opening formed by the first pattern.
Figure 3B:
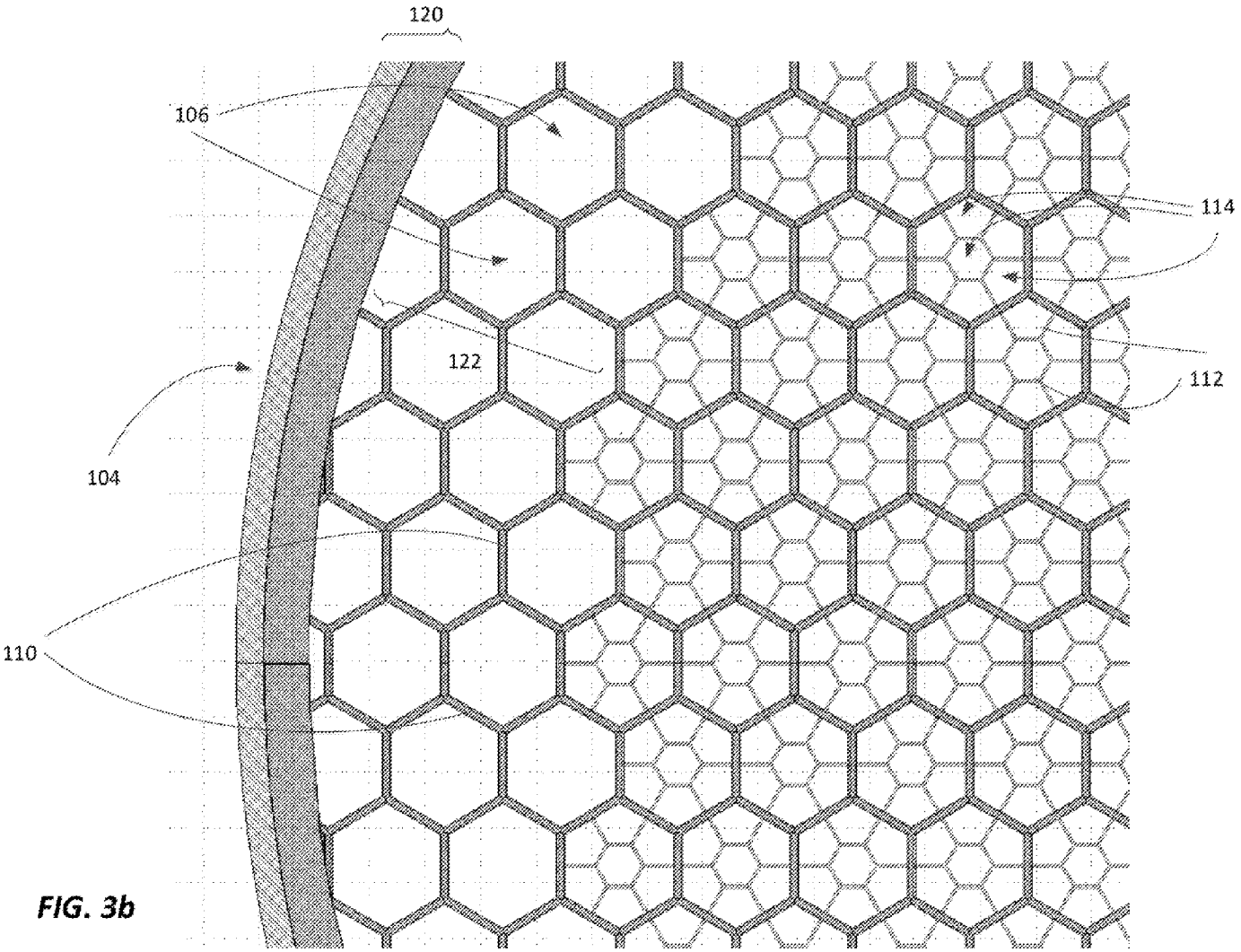
Figure 3C:
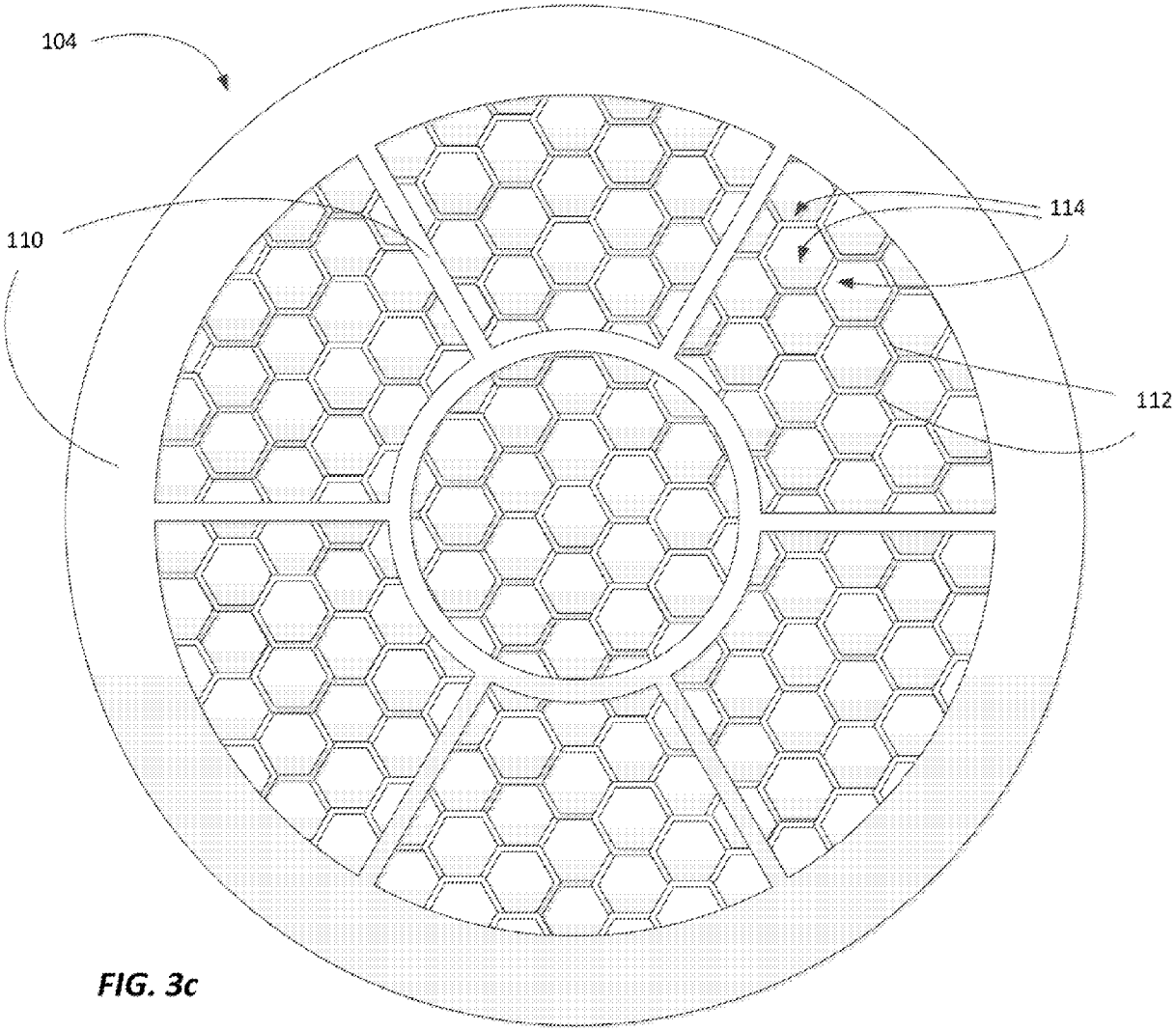
Figure 3D:
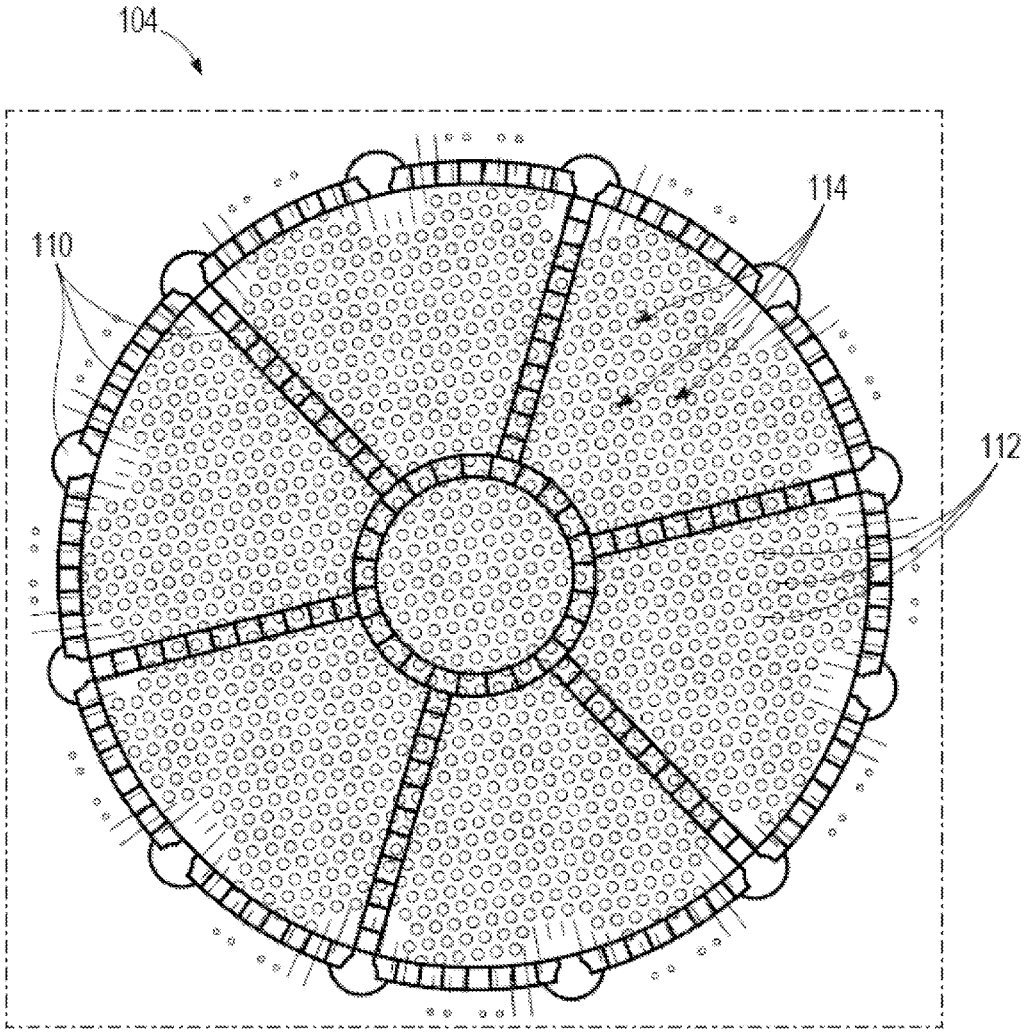

FIG. 3*a* is a top view of a backplate 104 having, a first mesh pattern and a second mesh pattern contained within the opening formed by the first pattern. In particular, as illustrated in FIG. 3*a*, the backplate 104 has a first pattern of hexagon mesh structures 110. A second mesh pattern formed by the openings between the elements 112 is contained within each of the primary mesh structures 110, with two different embodiments shown consisting of a combination of hexagonal and pentagonal mesh openings patterns or by hexagonal and trapezoidal mesh openings. The first pattern can consist of wider material and/or a thicker layer and thus serves as a structural layer providing additional stiffness and strength to the backplate in addition to providing electrical sense functionality. Accordingly, both examples of the second pattern provide a finer pattern of smaller openings which could also be in a thinner layer. The second pattern can be used to keep debris and other foreign material from coming in contact with the membrane 102 and can be used to increase the capacitive area of the backplate with less loss of acoustic signal to noise ratio by using a more fragile mesh structure with narrower and thinner elements between vent hole apertures. In some embodiments, the second pattern is formed from a different material than the first pattern (e.g., a material with a different stiffness, a different internal stress, a different strength, a different electrical conductivity, a different dielectric constant). It should be understood that the second pattern can include different mesh patterns than the first mesh pattern. For example, the first pattern can include hexagon mesh patterns and the second pattern can include triangular mesh patterns. It should also be understood that different second mesh patterns (i.e., different sized and/or different shaped apertures 114) can be used in the openings of the first pattern. In some embodiments, the second mesh can be varied across the backplate to adjust the distribution of capacitance across the backplate, e.g. to improve device sensitivity or to control particle filtering. Also, in some embodiments, the resulting beam elements 112 of the second pattern (i.e. a ligament of material between the second pattern openings) have a different thickness or size than the beam elements 110 of the first pattern. The mesh in the first pattern 110 can be constructed of the same material layers or different material layers than the mesh in the second pattern 112. FIG. 3*b* shows one embodiment of a perimeter attachment region 120 (e.g. consisting of a non-perforated circular perimeter) and an associated means of terminating the first mesh pattern into this perimeter region. The embodiment shown in FIG. 3*b* has the second pattern removed around a perimeter 122 of the backplate and thus included only in the center of the backplate. FIG. 3*c* shows a plan view of a backplate 104 in which the first coarse mesh pattern formed by linear and curved segments is independent from the second mesh pattern formed by hexagonal openings. FIG. 3*d* shows a plan view of a backplate 104 in which the first coarse mesh pattern consisting of large openings and small openings in a first layer is independent from the second mesh pattern formed by circular openings and an irregular arrangement of slots. Discrete connection points around the perimeter of the first pattern are also demonstrated.

Figure 4:
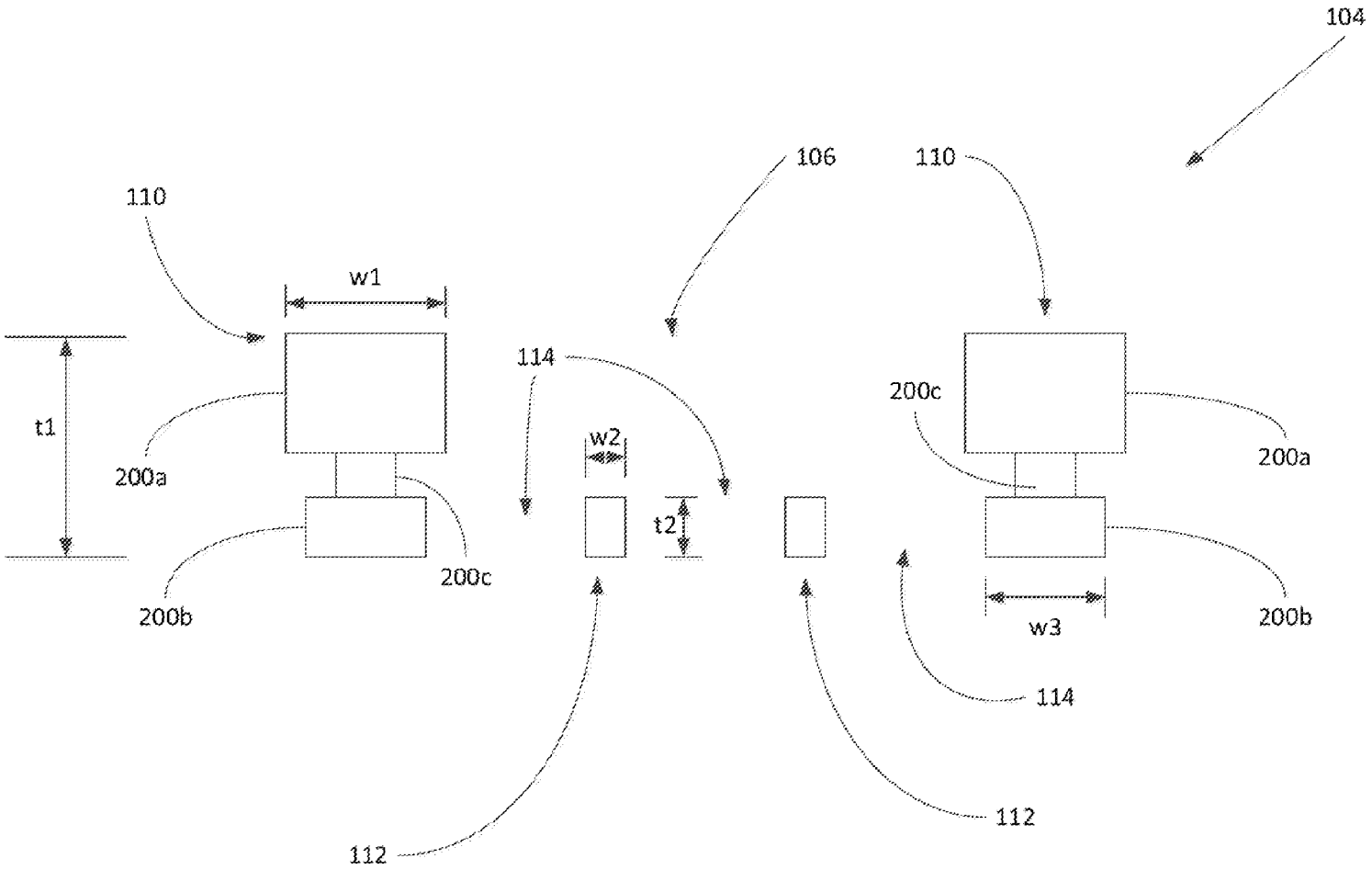
FIG. 4 is a side, cross-sectional view of the backplate of FIGS. 3*a* and 3*b*.
Figure 5:
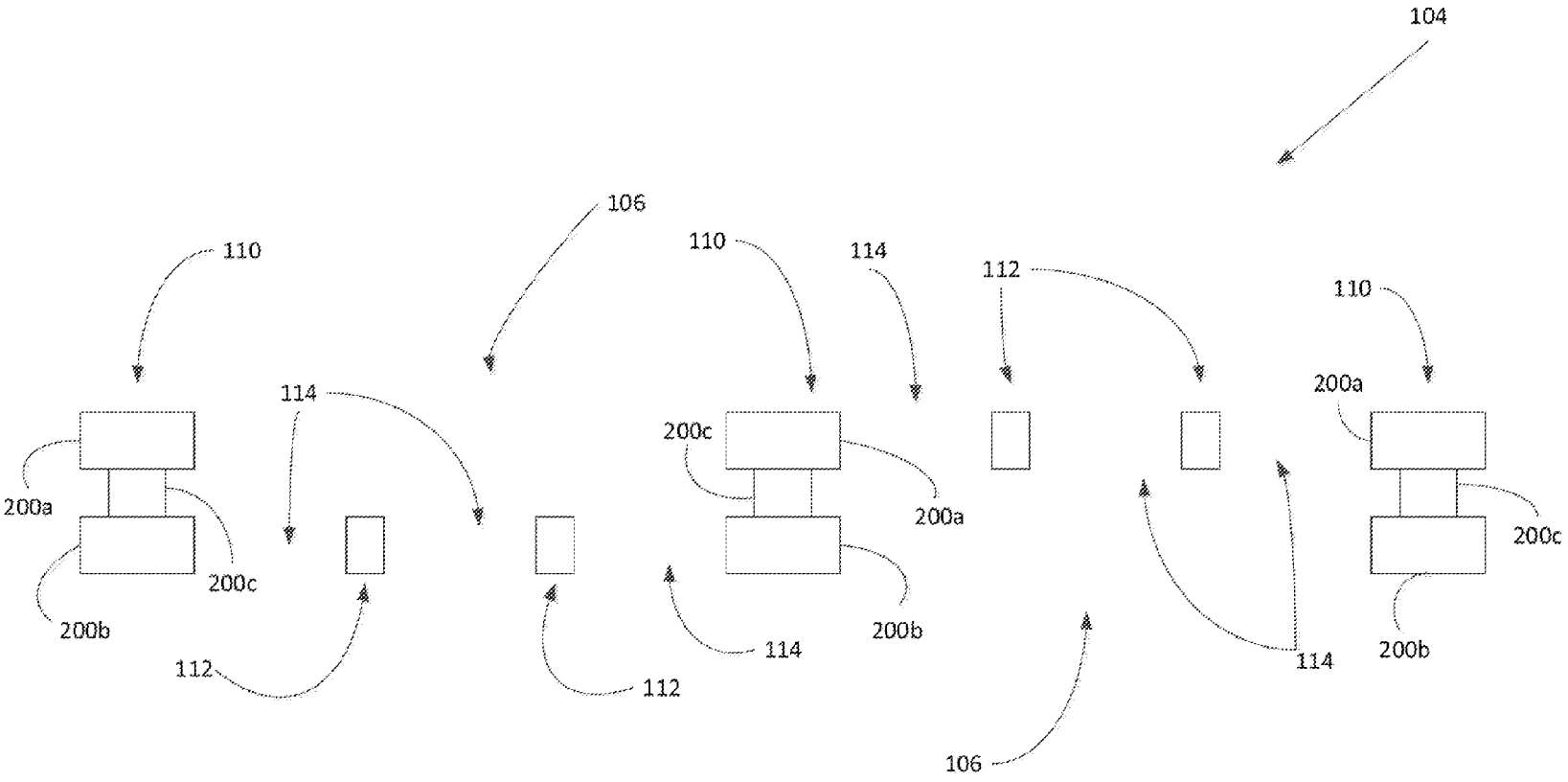
FIG. 5 is a side, cross-section view of a backplate having a first mesh and a second mesh pattern contained within the opening formed by the first pattern, wherein the second pattern alternates between a top layer and a bottom layer of the backplate.

In some embodiments, when the backplate includes a second pattern within a first pattern as illustrated in FIGS. 4*a* and 4*b*, a composite backplate 104 is used as illustrated in FIG. 4. In one embodiment, the backplate 104 includes a top layer 200*a* and a bottom layer 200*b*. An optional interconnect layer 200*c* can connect the top layer 200*a* and the bottom layer 200*a*, and though not shown additional interconnect layers 200*c* with additional top layers 200*a* may be added on top of each other. As illustrated in FIG. 4, one of the layers (e.g., the top layer 200*a*) can be used to form the first pattern and the other layer (e.g., the bottom layer 200*b*) can be used to form the second pattern within the openings of the first pattern. As noted above, the beam elements 110 (i.e. a ligament of material between vent holes) in the first pattern (e.g., the top layer 200*a* illustrated in FIG. 4), can have a different width (w1) than the width (w2) of the beam elements 112 forming the second pattern (e.g., the bottom layer 200*b*). It should also be understood that in some embodiments, both the first and second patterns are formed by one layer of the backplate 104 (e.g., the top layer 200*a*). In some embodiments, the thickness of the second pattern structures can be varied by selectively etching a single layer to remove material. In some embodiments, the thickness of the first pattern and/or second pattern can be increased by filling a narrow trench with a width that is less than twice the thickness of the deposited material. In some embodiments, the stiffness of the first pattern layer may be increased by filling a trench, in a lower layer, with a width that is more than twice the thickness of the deposited material. In some embodiments, the stiffness of the first pattern layer may be increased by depositing material over a vertical bump in a lower layer. Furthermore, as illustrated in FIG. 5, in some embodiments, the second pattern alternates positions between the top layer 200*a* and the bottom layer 200*h*. In these embodiments, the backplate 104 when viewed in cross-section has a wave-like or stepped shape due to the alternating position of the second pattern. This alternating position configuration allows for the continued benefit of particle filtering while also reducing electrical capacitance in select locations.

Although the embodiments shown herein use straight beam sections, other embodiments may also include curved beams. Also, it is recognized that for robust design of patterned backplate meshes which result in beam elements between vent hole apertures, filleting at the corners of the vent hole apertures may be applied to create filleted beam intersections.

A person skilled in the art would know that these mesh pattern structures are fabricated using known methods such as by depositing material layers and subsequently patterning them.

Thus, embodiments of the invention provide, among other things, a backplate containing one or more mesh patterns consisting of openings in the backplate. The use of such patterns results in a higher acoustic signal-to-noise ratio (while providing a strong structure), better particle filtering, and the ability to reduce parasitic capacitance at the perimeter of the membrane, while also maintaining or improving backplate stiffness and strength (ie. robustness). It should be understood that the mesh patterns illustrated in the present application can include but is not limited to uniform-width beam structures between vent hole apertures. Furthermore, it should be understood that the same patterns can be used with a front plate used in a MEMS microphone system (i.e. the embodiments described are independent of the relative position to the membrane). Furthermore, the backplate can be fabricated using CMOS MEMS material layers and processes or traditional MEMS material layers and processes. Additional details are found in the attached figures and images.

Various features and advantages of the invention are set forth in the following claims.

What is claimed is:

1. A MEMS backplate, the MEMS backplate comprising:

a first mesh pattern having a first height and a first arrangement of openings; and a second mesh pattern having a second height and a second arrangement of vent holes, the second mesh pattern contained within the opening formed by the first mesh pattern;

wherein the second height is less than the first height.

2. The MEMS backplate of claim 1, wherein the first pattern and second pattern are formed in the same layer.

3. The MEMS backplate of claim 2, wherein the first pattern and second pattern are formed by selectively etching portions of a layer to vary the thickness.

4. The MEMS backplate of claim 1, wherein the first pattern is stiffened by depositing material into a trench formed in lower layers.

5. The MEMS backplate of claim 1, wherein the second pattern is stiffened by depositing material into a trench formed in lower layers.

6. The MEMS backplate of claim 1, wherein the first pattern is stiffened by depositing material onto a bump formed in lower layers.

7. The MEMS backplate of claim 1, wherein the second pattern is stiffened by depositing material onto a bump formed in lower layers.

8. The MEMS backplate of claim 1, comprising multiple layers wherein a layer can consist of a single deposited material or multiple deposited materials patterned in a single lithography step.

9. The MEMS backplate of claim 8, wherein the first mesh pattern is formed by a first layer and the second mesh pattern is formed by a second layer.

10. The MEMS backplate of claim 9, further comprising a spacer layer, wherein the first layer is coupled to a first side of the spacer layer and the second layer coupled to a second side of the spacer layer.

11. The MEMS backplate of claim 1, wherein the second mesh pattern increases the capacitance of the backplate providing additional sensitivity.

12. The MEMS backplate of claim 1, wherein the second mesh pattern forms a plurality of small apertures.

13. The MEMS backplate of claim 12, wherein the small apertures improves filtering of particles by the backplate.

14. The MEMS backplate of claim 1, wherein the second mesh pattern improves the signal-to-noise ratio of a device containing the backplate.

15. The MEMS backplate of claim 1, further comprising a first layer and a second layer.

16. The MEMS backplate of claim 15, wherein the first mesh pattern is formed by the first and second layers.

17. The MEMS backplate of claim 16, wherein the second mesh pattern is formed in the first layer, or in the second layer, or in the first layer in some locations and in the second layer in some locations.

18. The MEMS backplate of claim 1, wherein the first mesh pattern supports the second mesh pattern allowing the second mesh pattern to be narrower and thinner.

19. The MEMS backplate of claim 1, wherein the backplate first mesh pattern is placed nearest to the membrane.

20. The MEMS backplate of claim 1, wherein the backplate second mesh pattern is placed nearest to the membrane.

* * * * *